United States Patent [19]

Eckart

[11] 3,998,475

[45] Dec. 21, 1976

[54] SAFETY SKI BINDING

[76] Inventor: Erich Eckart, Oettingenstrasse 54, D-8000 Munich 22, Germany

[22] Filed: Dec. 4, 1974

[21] Appl. No.: 529,400

[30] Foreign Application Priority Data

Dec. 8, 1973 Germany ..... 2361245
Feb. 5, 1974 Germany ..... 2405514

[52] U.S. Cl. ..... 280/623; 280/620; 280/628

[51] Int. Cl.[2] ..... A63C 9/081

[58] Field of Search ..... 280/11.35 Y, 11.35 K, 280/11.35 R, 11.35 D, 11.35 G, 11.35 T, 628, 620, 618, 623

[56] References Cited

UNITED STATES PATENTS

| | | | |
|---|---|---|---|
| 2,676,813 | 4/1954 | Beyl | 280/11.35 Y |
| 2,955,300 | 10/1960 | Hedlund et al. | 280/11.35 Y |
| 3,563,561 | 2/1971 | Mottet | 280/11.35 T |
| 3,572,739 | 3/1971 | Erlebach | 280/11.35 T |
| 3,618,965 | 11/1971 | Hecker | 280/11.35 C |
| 3,764,155 | 10/1973 | Perryman | 280/11.35 Y |
| 3,813,109 | 5/1974 | Salomon | 280/11.35 Y |
| 3,888,499 | 6/1975 | Gertsch et al. | 280/11.35 K |

FOREIGN PATENTS OR APPLICATIONS

| | | | |
|---|---|---|---|
| 1,166,145 | 11/1958 | France | 280/11.35 Y |
| 458,163 | 8/1968 | Switzerland | 280/11.35 T |

*Primary Examiner*—M. H. Wood, Jr.
*Assistant Examiner*—David M. Mitchell

[57] ABSTRACT

A safety ski binding is designed so that the ski boot resting on a plate joined permanently but pivotally to the ski is secured only by a single holding element, which is designed as a heel element. This holding element is joined to the ski so that it can be swivelled toward all sides, and has a release mechanism which releases the ski boot both in case of forward falls and in case of torsional falls. The release characteristic can be differently adjusted in different directions in accordance with the tensile and torsional stresses to which the leg is subjected.

12 Claims, 9 Drawing Figures

SAFETY SKI BINDING

BACKGROUND OF THE INVENTION

The present invention relates to a safety ski binding with a plate pivotally mounted on the ski adapted to receive the ski boot, and with swivelling, spring-mounted holding elements with directional release characteristics.

Such a safety ski binding secures the ski boot to the ski and releases the boot in case of falls, overcoming the release forces predetermined by the release characteristics of the holding elements. The conditions for such a safety ski binding are determined by the ski's leverage on the leg.

In the known binding systems, the ski boot is generally secured to the ski by means of a toe iron and a heel element, with the toe iron releasing the boot upon occurrence of excessive torsional loads, and the heel element in case of forward falls.

In safety ski bindings of this kind, the toe iron and the heel element are permanently joined to the ski. This two-point attachment and two-point release has disadvantages, which are accounted for as follows:

Since the distance between these two holding elements changes with the bending of the ski, the constancy of the release sequence is not insured with the predetermined setting as a result of the varying influence exerted on the two holding elements.

It has also been tried to achieve an improvement by using a plate which receives the boot and is pivotally mounted on the ski. This results in a slightly better constancy of the set release values, but the disadvantages of the two-point attachment and of the two-point release remain; they are mainly due to the use of a toe iron.

The torque of the ski is transmitted via the toe iron and via the heel element to the leg. At these two points of application, the point of the foot and the heel, however, the leg, according to the principle of the lever, can be twisted by a minimum force applied thereto, in which case the torsional movements initiated via the point of the foot because of the long lever from the point of the foot to the leg's axis of rotation may be especially harmful to the leg.

The toe iron, therefore, requires a precise setting of the point of release. However, this precise setting of the toe iron is rendered difficult by the fact that the following factors must be considered: height of the skier, fone frame, skiing ability, boot size, boot material, boot stiffness, sole quality, sole stiffness. Thus, the great number of these variables and the deformation of the ski boot between the binding elements in case of the ski being bent through will easily result in a false setting of the toe iron's point of release.

In addition, considering the anatomy of the foot, it is wrong to choose the front of the boot as the point to which the torque releasing the ski upon occurrence of an excessive torsional stress is applied. The front portion of the foot and the anklebone form the upper ankle joint, i.e. an angle joint, while the heel bone and the anklebone constitute the swivel joint of the foot.

It is the object of the present invention to design a safety ski binding of the kind referred to by way of introduction in such a manner that the set release values can be kept virtually constant and also independent of deflections of the ski, avoiding, as far as possible, forces due to lever action, and that, in case of falls, the transmission of the release forces to the holding element can be effected without the leg being subjected to the aforementioned detrimental stresses.

SUMMARY OF THE INVENTION

The invention is characterized in that a pivotally mounted plate extends along the entire length of the ski boot, is permanently, but pivotally attached to the ski at the center of rotation of the leg, and has only guide elements for the toe of the ski boot, and that said pivotally mounted plate has only a single holding element associated therewith which is designed as a heel element, is joined to the ski so as to be capable of swivelling toward all sides, and has a release characteristic which operates in all directions and is adapted to the different load-carrying capability of the leg regarding torsional and tensile loads. In this design, the only resilient holding element takes over the release of the foot, both in case of "torsional" falls and in case of forward falls, it being possible to allow for the different load-carrying capability of the leg in optimal manner. In addition, this novel safety ski binding is less expensive.

For its support, the pivotally mounted plate is secured via a formed-on pivot in the inner ring of a ball bearing whose outer ring is secured in a holder joined to the ski. To obtain a defined initial position of the pivotally mounted plate in relation to the ski, the pivotally mounted plate is held in the direction of the ski point via an engaging spring, and the engaging spring is attached to the ski and moves into engagement with an engaging groove at the bottom side of the pivot.

For guiding the toe of the ski boot, a holding stirrup spring-mounted on both sides is joined as a guide element for the toe of the boot to the pivotally mounted plate; this holding stirrup can simultaneously perform the function of horizontal length compensation.

To permit the lateral swivelling of the pivotally mounted plate to be transmitted to the heel element, the pivotally mounted plate has a recess which faces the heel element and is engaged by an extension, preferably by the closing tongue of the heel element, whereby both are mutually guided.

A structural embodiment of the heel element is characterized in that the heel element comprises a vertical bearing cylinder with a semispherical end which bearing cylinder is permanently joined to the ski and on which a ball is horizontally pivotally mounted, that said ball is surrounded by a housing to which the heel jaw is secured, that the housing receives two concentrically disposed helical compression springs, with the inner helical compression spring extending through an opening of the ball and abutting against a flat portion of the bearing cylinder, and the outer helical compression spring abutting against a flat portion surrounding the opening of the ball, and that the two helical compression springs are additionally supported by abutments adjustable in the housing. Via the two helical compression springs and in conjunction with the abutment faces at the bearing cylinder and at the ball, the release forces in the vertical and horizontal directions as well as in the intermediate positions can be unambiguously determined and adjusted. The abutments themselves are designed as heel jaws, or are at least parts thereof. The size of the flat portions of the bearing cylinder and of the ball determine the release zone, i.e., the permissible play between ski boot and ski.

For the adjustment of the heel element, the housing enclosing the ball has an opening for the bearing cylinder, which opening permits the housing to be vertically swivelled on the ball end, consequently, on the bearing cylinder. The helical compression springs are accommodated in a hollow extension of the housing, to whose end the heel jaw is attached.

The shorten the lever between heel jaw and swivel point, another preferred embodiment is characterized in that the heel jaw is formed directly onto the housing, that the helical compression springs are accommodated in an extension of said housing which extension is formed onto that side of the housing which is turned away from the heel jaw, and that on said side there are also provided the flat portions of the bearing cylinder and of the ball. Thus, the tolerance zone of the torque can be further restricted.

To simplify the holding element, with the release characteristic responsive to forces from all sides being retained, a further embodiment is characterized in that the extension of the housing receives only a single helical compression spring which abuts against the flat portion of the ball, that two further flat portions adjoin said flat portion at the sides, that the vertical distances between said three flat portions and the center of the ball lie in one plane, and that the section planes of said three flat portions on the ball border on each other as a secant and not as a tangent. The adaptation of the release characteristic in the vertical and horizontal directions to the different load-carrying capability of the leg with respect to torsional and tensile loads is achieved by choosing the distance between the central flat portion of the ball and the center of the ball to be smaller than the same distances between the laterally adjacent flat portions and the center of the ball.

The invention will now be explained in more detail with reference to the accompanying drawings, showing, by way of example, various embodiments of the invention.

DESCRIPTION OF INVENTION

Figure 1:
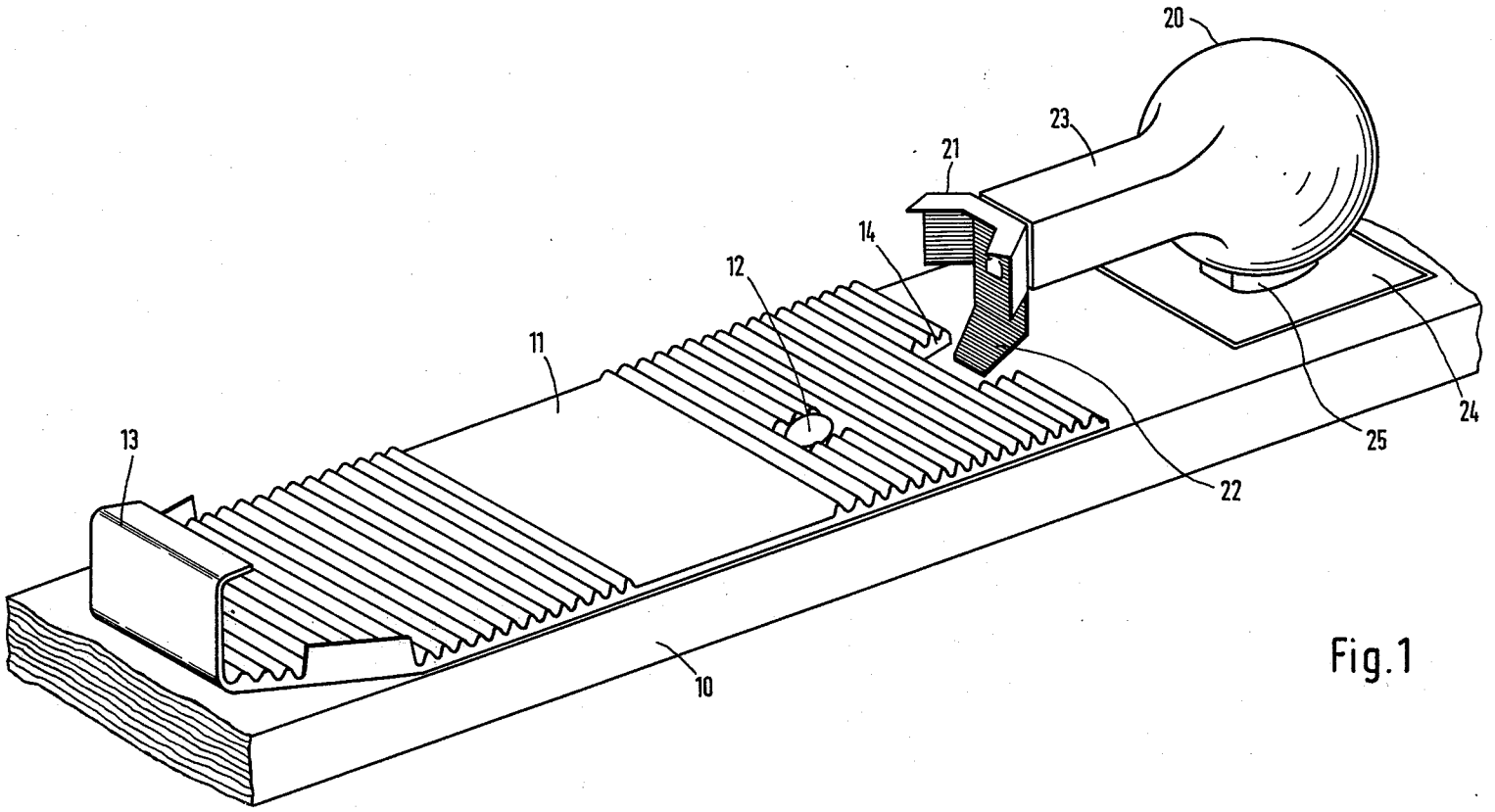
FIG. 1 is a partial view of a ski with a safety ski binding in accordance with the invention.
Figure 2:
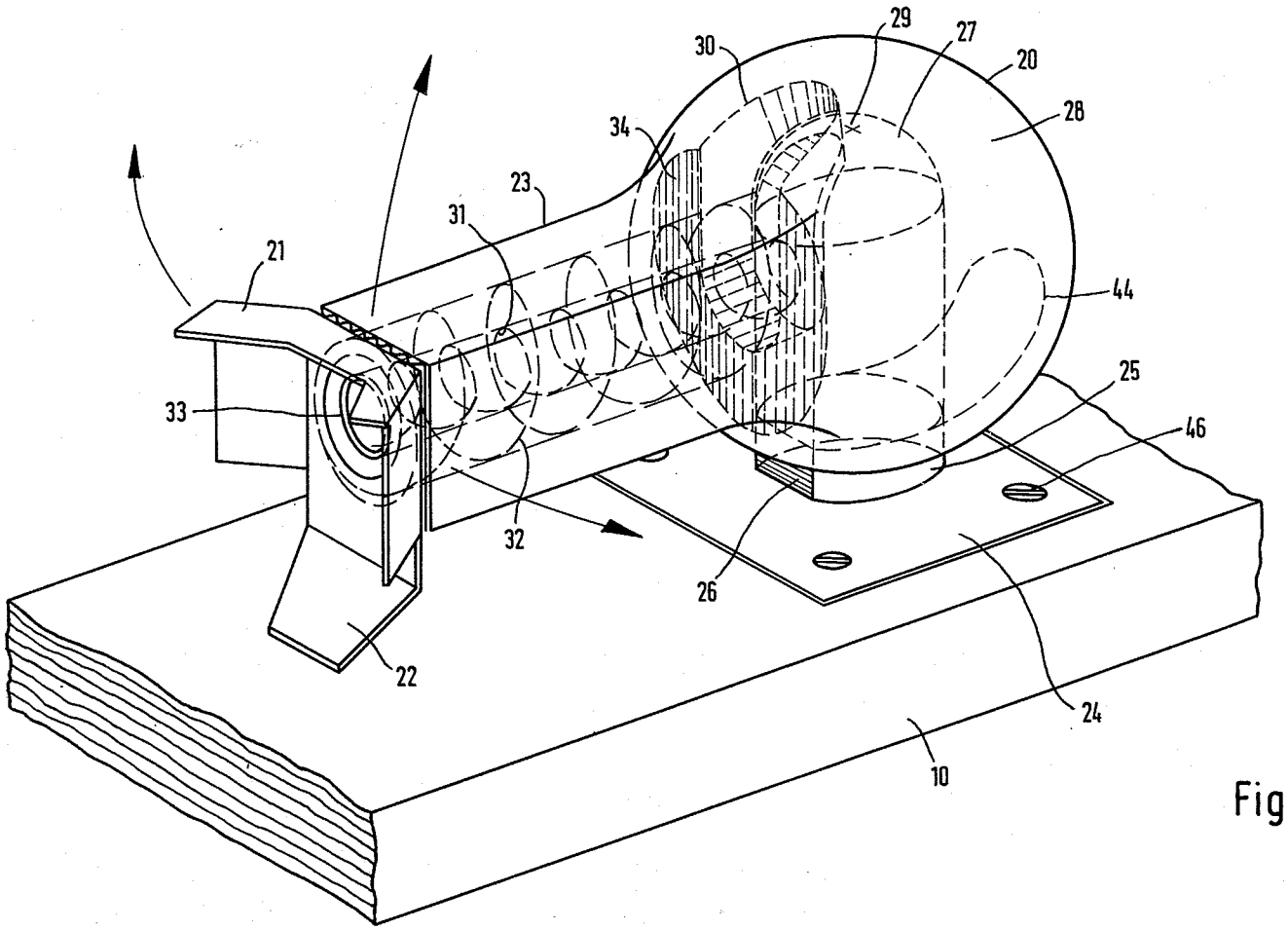
FIG. 2 is an enlarged representation of the heel element of the safety ski binding of FIG. 1.

As shown in FIG. 1, a plate 11 is pivotally mounted on the ski 10 in a pivot bearing 12. This pivotally mounted plate 11 carries guide elements 13, which hold the toe of the ski boot in position. This pivotally mounted plate 11 extends along the entire length of the ski boot. At the rear the pivotally mounted plate 11 has a central recess 14 which is engaged by an extension 22 of the heel element, whereby both are mutually guided. This extension is preferably designed as a closing tongue. The heel element is screwed to the ski by means of the plate 24 and the screws 46. This plate 24 carries a bearing cylinder 25 which has a flat portion 26 facing the pivotally mounted plate 11 and passes into a semispherical portion 27 at the end, as shown in FIG. 2. On this bearing cylinder 25 a ball 28 with a corresponding receptacle is horizontally pivotally mounted, as indicated by the bearing point 29. The housing 20 encloses this ball 28, but has a slot-like opening 44, which permits the housing 20 to be vertically swivelled on the ball 28. Hence, the housing 20 with the hollow extension 23 and with the heel jaw 21 is capable of being swivelled toward all sides. The ball 28 has an opening 30 through which extends the smaller helical compression spring 31, which abuts on the flat portion 26 of the bearing cylinder 25 and on the abutment 33. This abutment 33 forms part of the heel jaw 21 and is threadedly adjustable at the extension 23 of the housing 20 in order to vary the tension of the helical compression spring 31. Adjacent to the opening 30, the ball has a flat portion 34 which supports the larger helical compression spring 32. Both helical compression springs 31 and 32 are concentric with one another and abut on the abutment 33.

Figure 3:
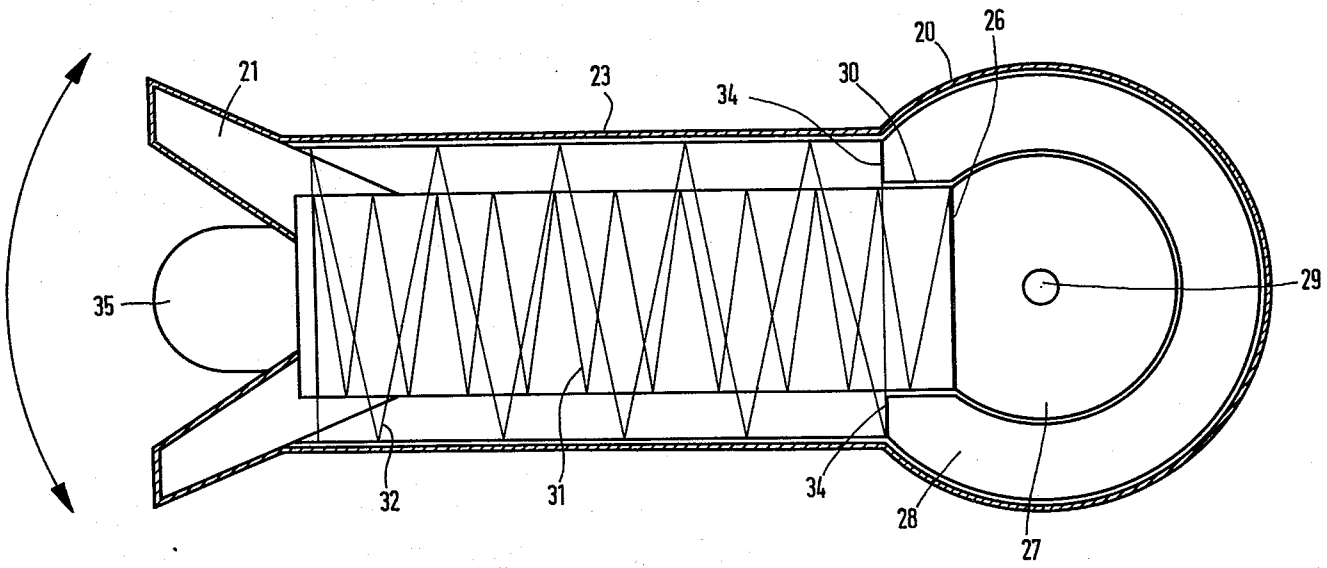
FIG. 3 is a horizontal section through the heel element of FIG. 2.

As can be seen in FIG. 3, if the heel jaw 21 is swivelled laterally, i.e. horizontally, the ball 28 will be swivelled about the bearing cylinder 25. In this case the tension of the helical compression spring 32 does not change. The helical compression spring 31, however, is moved on the flat portion 26 of the bearing cylinder 25 and tensioned. Only when the helical compression spring 31 has passed over a vertical edge of the flat portion 26 will the lateral release of the heel element be initiated.

Figure 4:
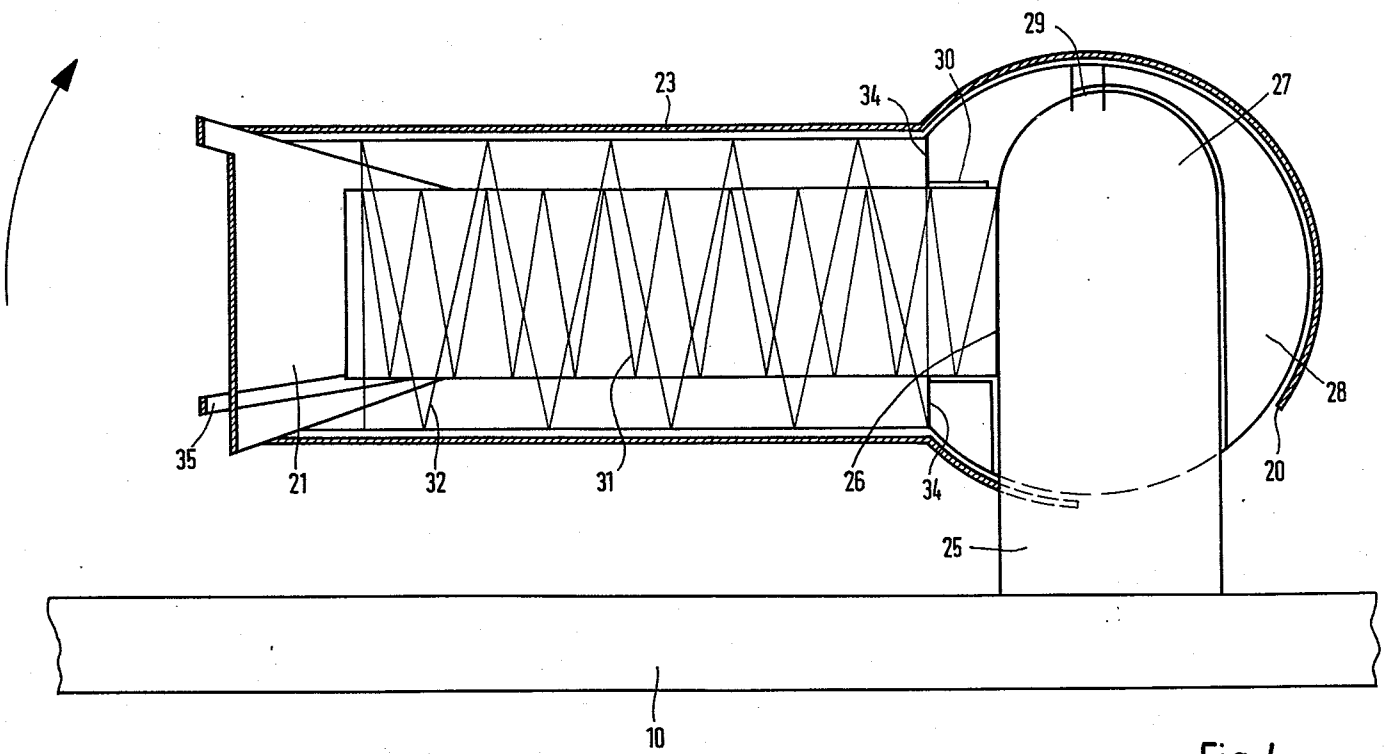
FIG. 4 is a vertical section through the heel element of FIG. 2.

As shown in FIG. 4, if the heel jaw 21 is swivelled vertically, the housing 20 will be swivelled about the ball 28. In this case, the helical compression spring 31 remains supported by the flat portion 26 of the bearing cylinder 25. The helical compression spring 32, however, slides over the flat portion 34 of the ball 28 and effects a vertical release.

In case of a diagonal shift of the heel jaw 21, the two release movements of the helical compression springs 31 and 32 are superimposed on each other.

Figure 5:
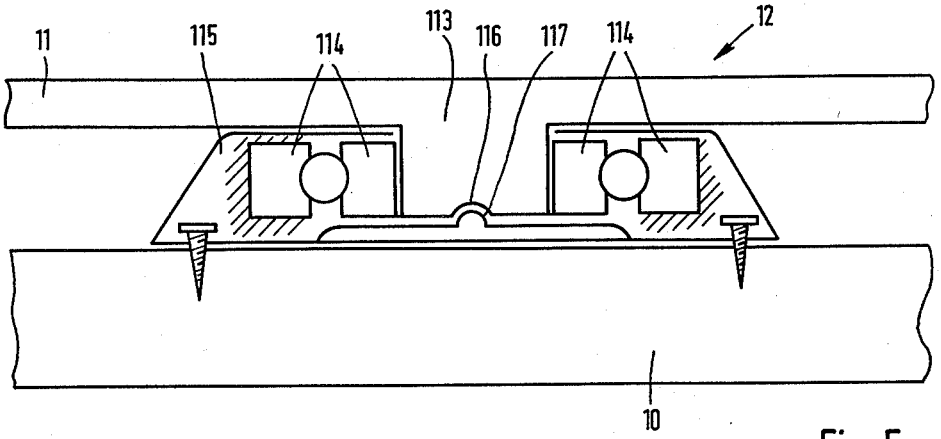
FIG. 5 shows how the pivoted plate is supported on the ski.

As shown in FIG. 5, the pivotally mounted plate 11 has on its bottom side a pivot 113 which is located in the inner ring of a conventional ball bearing 114. The outer ring of this ball bearing 114 is secured in the holder 115, which is joined to the ski 10. Attached to the ski 10 is an engaging spring 117 which engages with an engaging groove 116 of the pivot 113. This engaging connection of the spring 117 biases the pivotally mounted plate 11 in a longitudinally aligned starting position.

Figure 6:
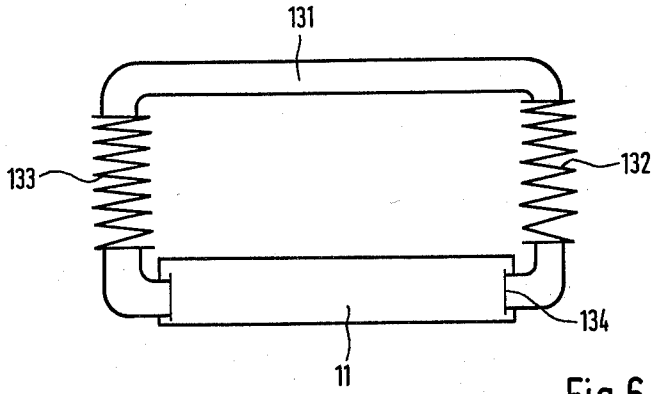
FIG. 6 shows a resilient holding stirrup as a guide element for the toe of the ski boot on the pivotally mounted plate.

FIG. 6 shows a U-shaped holding stirrup 131 whose two legs are connected with the bearing parts 134 via springs 132 and 133. These bearing parts 134 are pivotally attached to the pivotally mounted plate 11. This holding stirrup 131 forms a clamping receptacle for the toe of the ski boot and replaces the guide elements 13 of FIG. 1.

Figure 7:
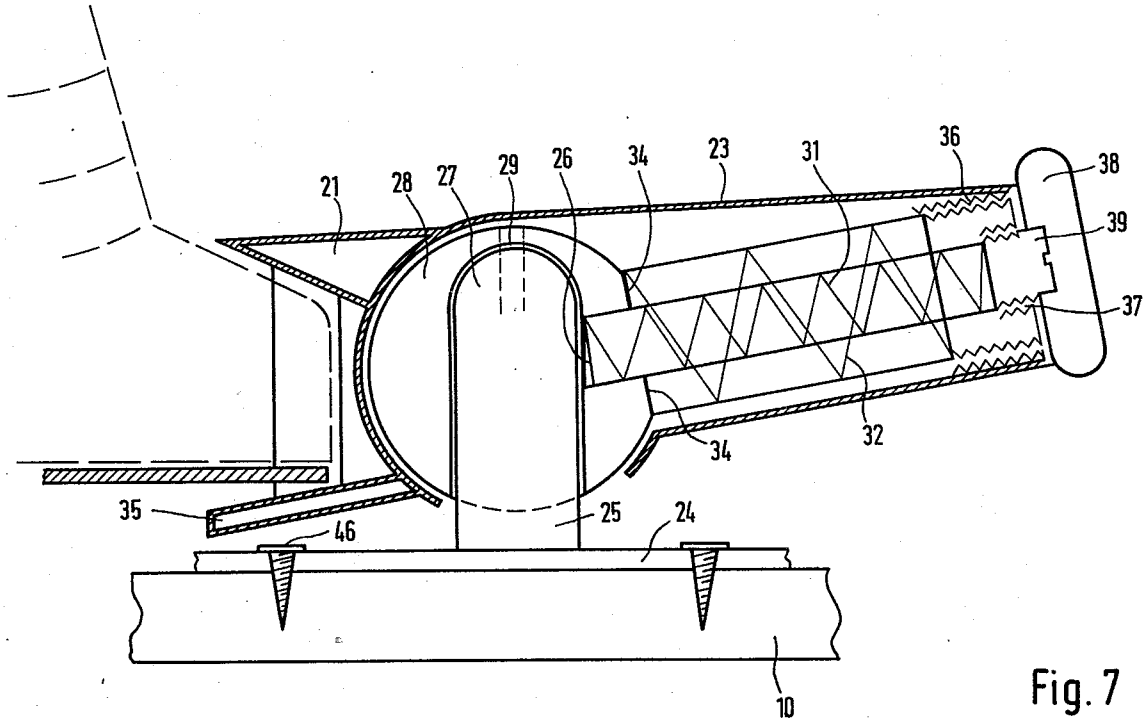
FIG. 7 shows a differently designed heel element whose heel jaw is attached with a short lever extending to the pivot point.

In the case of the heel element of FIG. 7, the heel jaw 21 is formed directly onto the housing 20. The extension 23 with the helical compression springs 31 and 32 is formed onto the opposite side of the housing 20. Therefore, the bearing cylinder 25 and the ball 28 have their flat portions 26 and 34 on the side turned away from the heel jaw 21. As indicated by the screw connections 36 and 37, the abutments 38 and 39 of the two helical compression springs 32 and 31 are individually adjustable. When the skier fits his boot into the ski binding, the closing tongue 35 is automatically urged downwards, so that the heel element takes up its starting position and the extension 22 moves into engagement with the recess 14 of the pivotally mounted plate 11.

Figure 8:
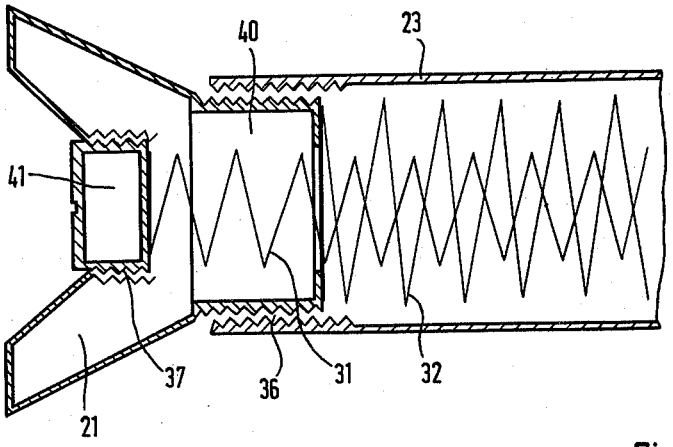
FIG. 8 shows the design of the heel jaw as an adjustable abutment for the helical compression springs of the heel element.

FIG. 8 shows how, in a heel element as shown in FIG. 2, the parts 40 and 41 of the heel jaws 21 can be used as abutments for the helical compression springs 31 and 32. These parts 40 and 41 are adjustable in the extension 23 and at the heel jaw 21, respectively.

Figure 9:
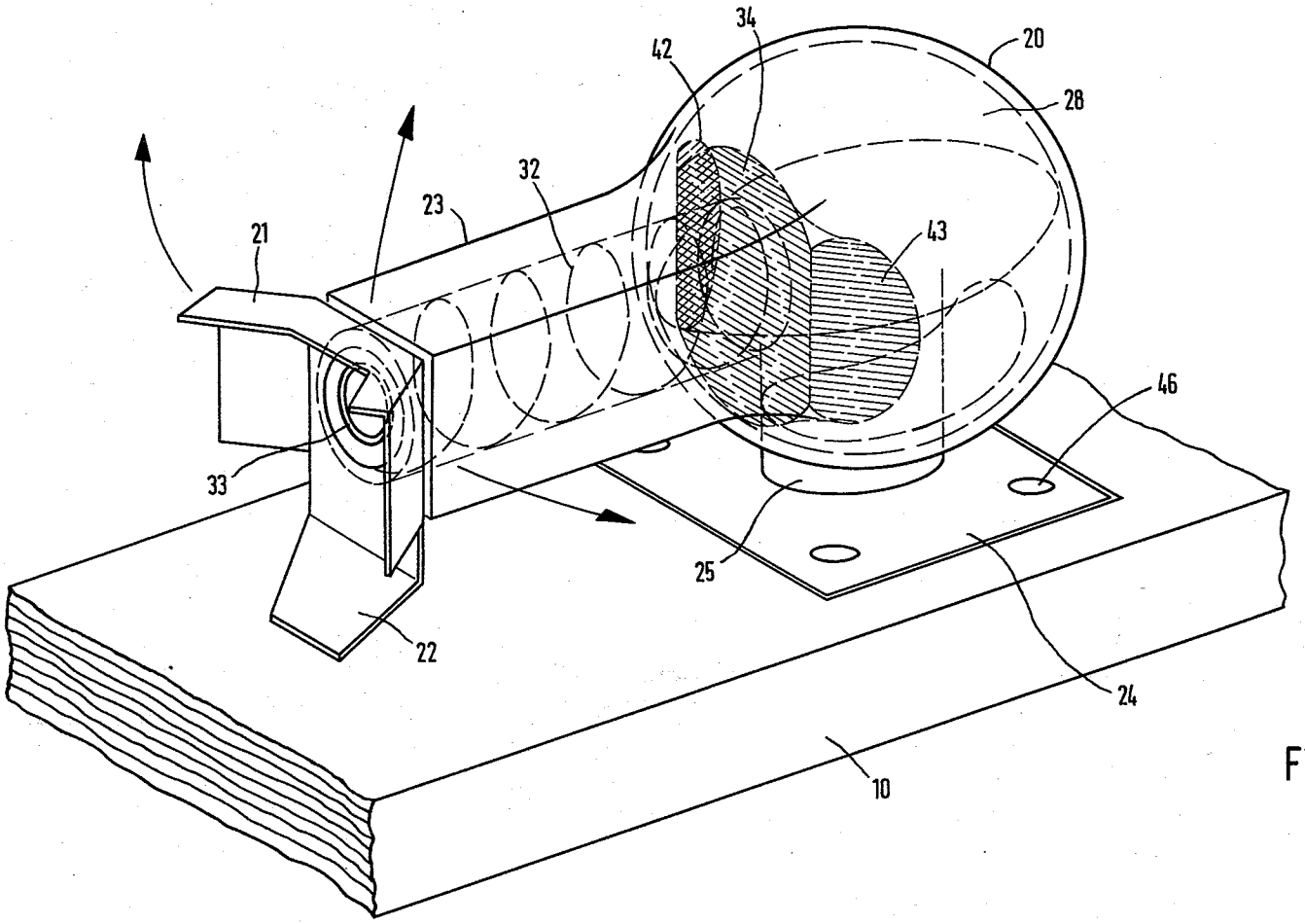
FIG. 9 shows a third embodiment of a heel element with a single compression spring for the release characteristic operating in all directions.

The embodiment of FIG. 9 uses only one helical compression spring 32, which abuts against the abutment 33 of the heel jaws 21 and against the ball 28. The abutment face at the ball 28 consists of the flat portion 34 and of the laterally adjacent flat portions 42 and 43. These three flat portions are arranged so that, in case of a forward fall, the helical compression spring 32 slides from the starting position on the flat portion 34 in the vertical direction onto the round portion of the ball 28, while in case of a torsional fall the helical compression spring slides in the horizontal direction onto one of the two adjacent flat portions 42 or 43.

The distance between the central flat portion 34 and the center of the ball is smaller than the same distances between the laterally adjacent flat portions 42 and 43 and the center of the ball. These distances are determined according to the predetermined empirical ratio of the tensile-load-carrying capability of the leg to the torsional-load-carrying capability of the leg, always related to the heel, because this is the only point where the heel element acts on the ski boot.

To be able to adapt the release characteristic in the diagonal direction, too, according to the invention, the transitions between the flat portions are rounded according to a cubic curve.

What is claimed is:

1. A safety binding for attachment of a ski to the boot of a skier comprising, in combination:

a plate coextensive with the length of the boot; means rotatably mounting said plate to the ski at the center of rotation of the leg of the skier; means mounted at one end of said plate for receiving the toe of said boot, and a heel holding element secured to the ski adjacent the other end of said plate, said heel holding element comprising: a vertical cylindrical bearing rod having a spherical upper end and a lower end fixedly secured to the ski; a ball member pivotally mounted circumferentially about said vertical cylindrical bearing rod for pivotal movement in a horizontal plane; a housing surrounding said ball member for pivotal movement relative to said ball member in the vertical direction, said housing having a heel jaw extending in a direction from said vertical cylindrical bearing rod toward said plate, and means for permitting the vertical pivotal movement of said housing relative to said ball member; means mounted within said housing for resiliently urging said extended heel jaw into holding engagement with the heel of a boot on the ski; and detent means for resisting horizontal and vertical movements of said housing formed on at least one of said ball member and said vertical cylindrical bearing rod for contacting said means for resiliently urging said heel jaw, said means for resiliently urging said heel jaw and said detent means being cooperable to releasably bias the heel jaw into said holding engagement and to effect release of said boot when said means for resiliently urging is moved with respect to said detent means.

2. The safety binding for attachment of a ski to the boot of a skier according to claim 1, wherein said means for permitting the vertical pivotal movement of said housing relative to said ball member comprises an elongated slot formed along a portion of said housing, said elongated slot receiving therethrough said vertical cylindrical bearing rod.

3. The safety binding for attachment of a ski to the boot of a skier according to claim 1 wherein said detent means includes at least one flattened surface formed on at least one of said ball member and said vertical cylindrical bearing rod, said means for resiliently urging said heel jaw in movable contact with said flattened surface and resisting movement beyond said flattened surface.

4. The safety binding for attachment of a ski to the boot of a skier according to claim 3, wherein said means for resiliently urging said extending heel jaw comprises inner and outer concentric compression springs each having a first end bearing against a portion of said housing and a second end spaced from said first end and bearing against one of said ball member and said vertical cylindrical bearing rod, said housing comprising an elongated extension for housing said inner and outer compression springs.

5. The safety binding for attachment of a ski to the boot of a skier according to claim 4, wherein said at least one flattened surface comprises a first flattened surface formed on said ball member and extends in a vertical plane parallel with said vertical cylindrical bearing member, said second end of said outer compression spring bearing against said first flattened surface.

6. The safety binding for attachment of a ski to the boot of a skier according to claim 5, wherein said first flattened surface comprises an elongated slot formed in a vertical portion thereof, and said detent means further comprises a second flattened surface formed on said vertical cylindrical bearing rod from said lower end toward said upper end and being exposed by said elongated slot, said second end of said inner compression spring bearing against said second flattened surface of said vertical cylindrical bearing rod via said elongated slot.

7. The safety binding for attachment of a ski to the boot of a skier according to claim 6, wherein said first ends of said inner and outer compression springs are connected to said extending heel jaw which constitutes said portions of housing, and said first and second flattened surfaces formed in said ball member and said vertical cylindrical bearing rod face in a direction toward said plate.

8. The safety binding for attachment of a ski to the boot of a skier according to claim 6, wherein said elongated extension extends from said ball member in a direction away from said plate, said elongated extension mounting therein said inner and outer compression springs and having a first end near said ball member and a second end spaced from first end in a direction away from said plate.

9. The safety binding for attachment of a ski to the boot of a skier according to claim 8 wherein said flattened surfaces of said vertical cylindrical bearing rod and said ball member face in a direction toward said second end of said elongated extension, said first ends of said inner and outer compression springs being connected to said second end of said elongated extension.

10. The safety binding for attachment of a ski to the boot of a skier according to claim 9, wherein said elongated extension comprises means for adjustably mounting said first ends of said inner and outer compression springs to said second end of said elongated extension.

11. The safety binding for attachment of a ski to the boot of a skier according to claim 3, wherein said means for resiliently urging said extending heel jaw comprises a compression spring having a first end bearing against said extending heel jaw and a second end spaced from said first end in a direction toward said ball member, and said at least one flattened surface comprises a flattened surface formed in a vertical portion of said ball member, said vertical portion facing in a direction toward said plate, said second end of said compression spring bearing against said flattened surface.

12. The safety binding for attachment of a ski to the boot of a skier according to claim 1, wherein said plate comprises a recess formed in said other end, and said extending heel jaw comprises a tongue which is received in said recess when said boot is held in locking engagement on the ski.

* * * * *